US009162346B2

(12) United States Patent
Chen

(10) Patent No.: US 9,162,346 B2
(45) Date of Patent: Oct. 20, 2015

(54) MULTIPLE SIZE SOCKET

(71) Applicant: Ander Chen, Chang-Hwa (TW)

(72) Inventor: Ander Chen, Chang-Hwa (TW)

(73) Assignee: INFAR INDUSTRIAL CO., LTD., Chang Hwa (TW)

( * ) Notice: Subject to any disclaimer, the term of this patent is extended or adjusted under 35 U.S.C. 154(b) by 252 days.

(21) Appl. No.: 13/933,244

(22) Filed: Jul. 2, 2013

(65) Prior Publication Data

US 2015/0013504 A1 Jan. 15, 2015

(51) Int. Cl.

| | |
|---|---|
| ***B25B 13/06*** | (2006.01) |
| ***B25B 23/00*** | (2006.01) |
| ***B25F 1/04*** | (2006.01) |
| ***B25B 13/56*** | (2006.01) |

(52) U.S. Cl.

CPC ..... *B25B 13/06* (2013.01); *B25B 13/56* (2013.01); *B25B 23/0007* (2013.01); *B25F 1/04* (2013.01)

(58) Field of Classification Search

CPC .... B25B 13/06; B25B 13/56; B25B 23/0035; B25G 1/063; B25F 1/04

See application file for complete search history.

(56) References Cited

U.S. PATENT DOCUMENTS

| | | | | |
|---|---|---|---|---|
| 8,387,489 | B2 * | 3/2013 | Hsu | 81/62 |
| 8,635,932 | B2 * | 1/2014 | Chen | 81/63 |
| 2011/0303052 | A1 * | 12/2011 | Chen | 81/57.5 |
| 2012/0036967 | A1 * | 2/2012 | Hsu | 81/62 |
| 2012/0118113 | A1 * | 5/2012 | Wu | 81/63.1 |
| 2012/0186403 | A1 * | 7/2012 | Chen | 81/62 |
| 2012/0240731 | A1 * | 9/2012 | Chu | 81/57.5 |
| 2013/0081517 | A1 * | 4/2013 | Wen | 81/57.5 |
| 2014/0331824 | A1 * | 11/2014 | Cumma | 81/124.5 |

* cited by examiner

*Primary Examiner* — David B Thomas
(74) *Attorney, Agent, or Firm* — Patent Office of Bang Shia

(57) ABSTRACT

A multiple size socket is provided with a base, a socket body, and a positioning unit. The base is provided with a connecting portion, two pivot portions and a pivot hole formed in each of the pivot portions. The socket body is pivoted between the two pivot portions and includes a plurality of engaging cavities and an inserting hole aligned with the two pivot holes. The positioning unit is inserted in the two pivot holes and the inserting hole. The engaging cavities are different in size and shape from one another, so that the socket is capable of driving different sized fasteners.

4 Claims, 6 Drawing Sheets

MULTIPLE SIZE SOCKET

BACKGROUND OF THE INVENTION

1. Field of the Invention

The present invention relates to a socket, and more particularly to a multiple size socket.

2. Description of the Prior Art

FIG. 1 shows a conventional socket 11 which includes an engaging cavity 111 for engaging with a fastener, such as screw or nut (not shown), and a connecting portion 112 for engaging with an engaging portion 121 of a hand tool 12, so that turning the hand tool 12 can perform screwing and unscrewing operation.

However, the size and shape of the engaging cavity 111 of the socket 11 are fixed and not adjustable, for example, the engaging cavity 111 is hexagonal or dodecagonal shaped, so that the socket 11 with the unadjustable engaging cavity 111 only fits a specific sized fastener. A user has to take various sockets 11 of different sizes when screwing and unscrewing different sized fasteners, and this is very inconvenient.

The present invention has arisen to mitigate and/or obviate the afore-described disadvantages.

SUMMARY OF THE INVENTION

The primary objective of the present invention is to provide a multiple size socket with different sized engaging cavities, so that a single socket of the present invention is capable of driving different sized fasteners, which makes the socket of the present invention easy to use and carry.

To achieve the above objective, a multiple size socket in accordance with the present invention comprises: a base with a connecting portion and two pivot portions; and a socket body pivoted between the two pivot portions and including a plurality of engaging cavities.

To achieve the above objective, another multiple size socket in accordance with the present invention comprises: a base, a socket body, and a positioning unit. The base is provided with a connecting portion, two pivot portions and a pivot hole formed in each of the pivot portions. The socket body is pivoted between the two pivot portions and includes a plurality of engaging cavities and an inserting hole aligned with the two pivot holes. The positioning unit is inserted in the two pivot holes and the inserting hole.

Preferably, the connecting portion is a hole or a protrusion.

Preferably, the engaging cavities are located around the inserting holes.

Preferably, the engaging cavities are different in size and shape from one another.

Preferably, one of the pivot holes is formed around an inner surface thereof with a plurality of shoulder portions, around an inner surface of the inserting holes is formed a plurality of serrations, the positioning unit includes a pin and a positioning assembly, the pin includes a head portion to be abutted against one of the pivot portions, a shaft portion connected to the head portion and inserted through the pivot holes and the inserting hole, a plurality of protrusions formed around the shaft portion and abutted against the shoulder portions, and a recess formed in the shaft portion and aligned to the serrations, the positioning assembly includes a spring received in the recesses and a ball received in the recesses and pushed by the spring against the serrations.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
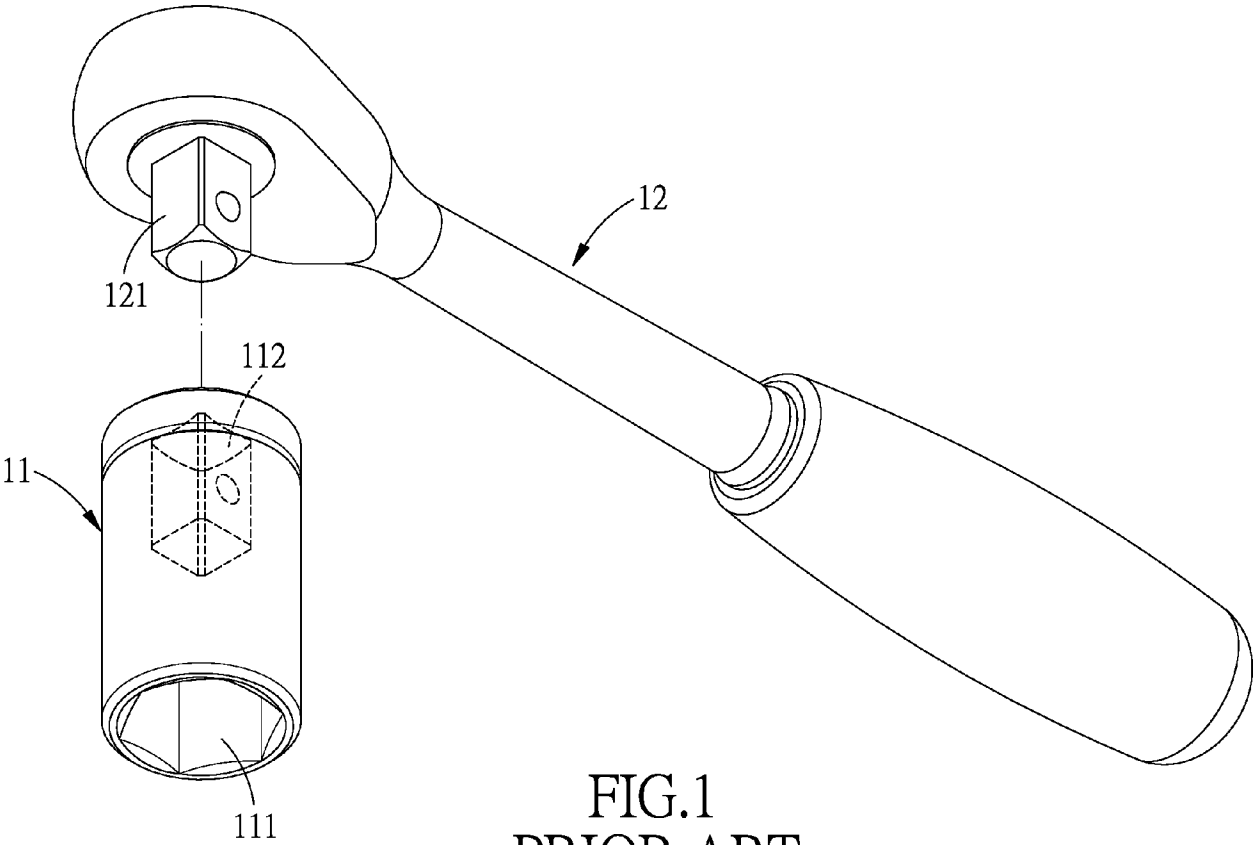
FIG.1 PRIOR ART
FIG. 1 shows a conventional socket and a hand tool.
Figure 2:
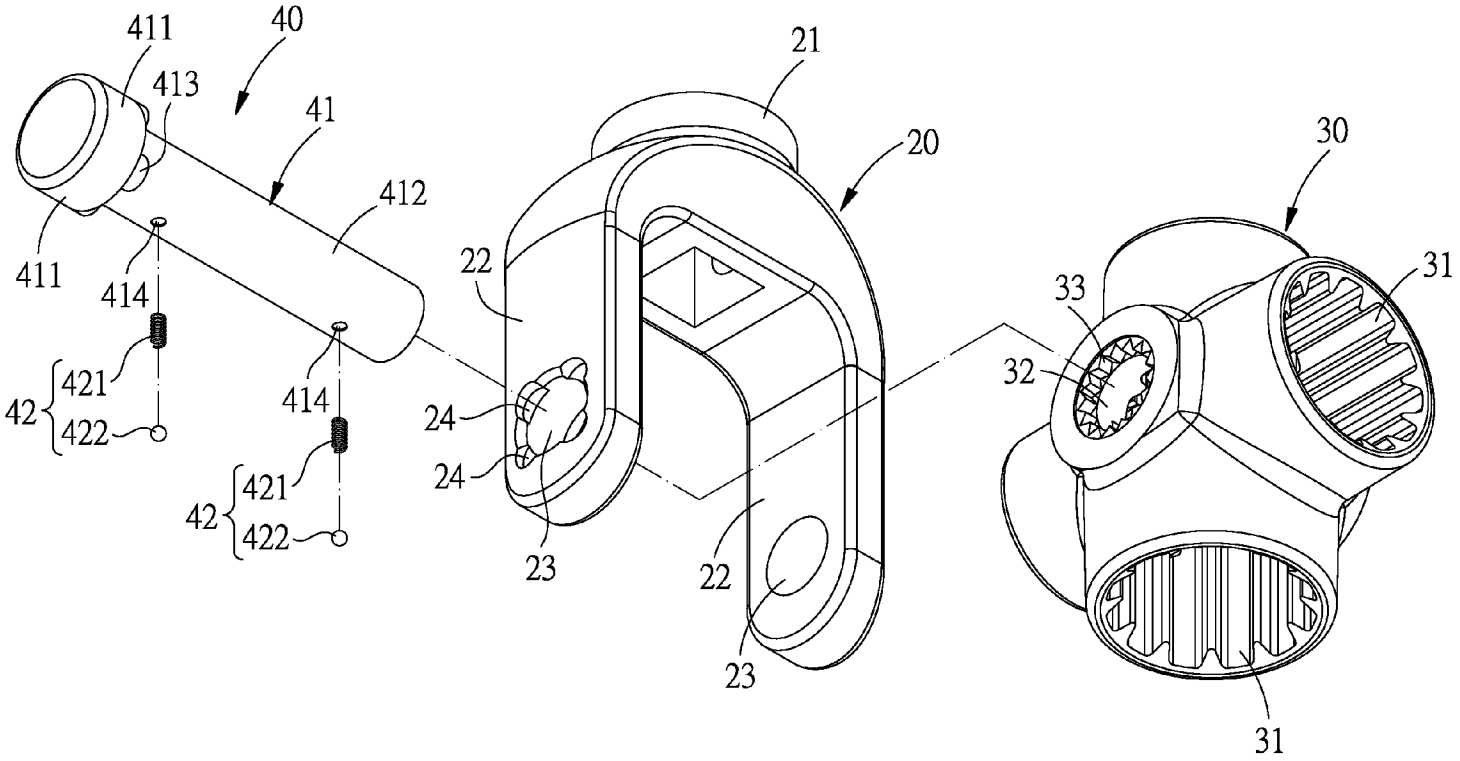
FIG. 2 is an exploded view of a multiple size socket in accordance with a first preferred embodiment of the present invention.
Figure 3:
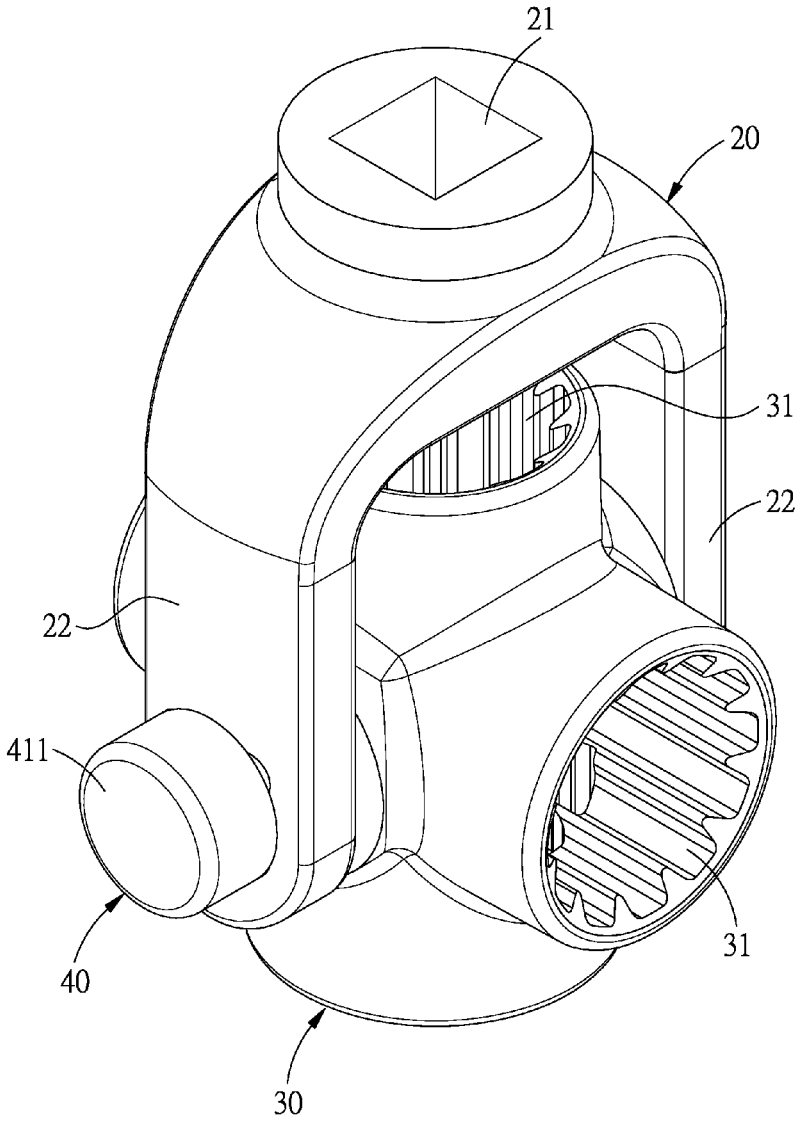
FIG. 3 is an assembly view of the multiple size socket in accordance with the first preferred embodiment of the present invention.
Figure 4:
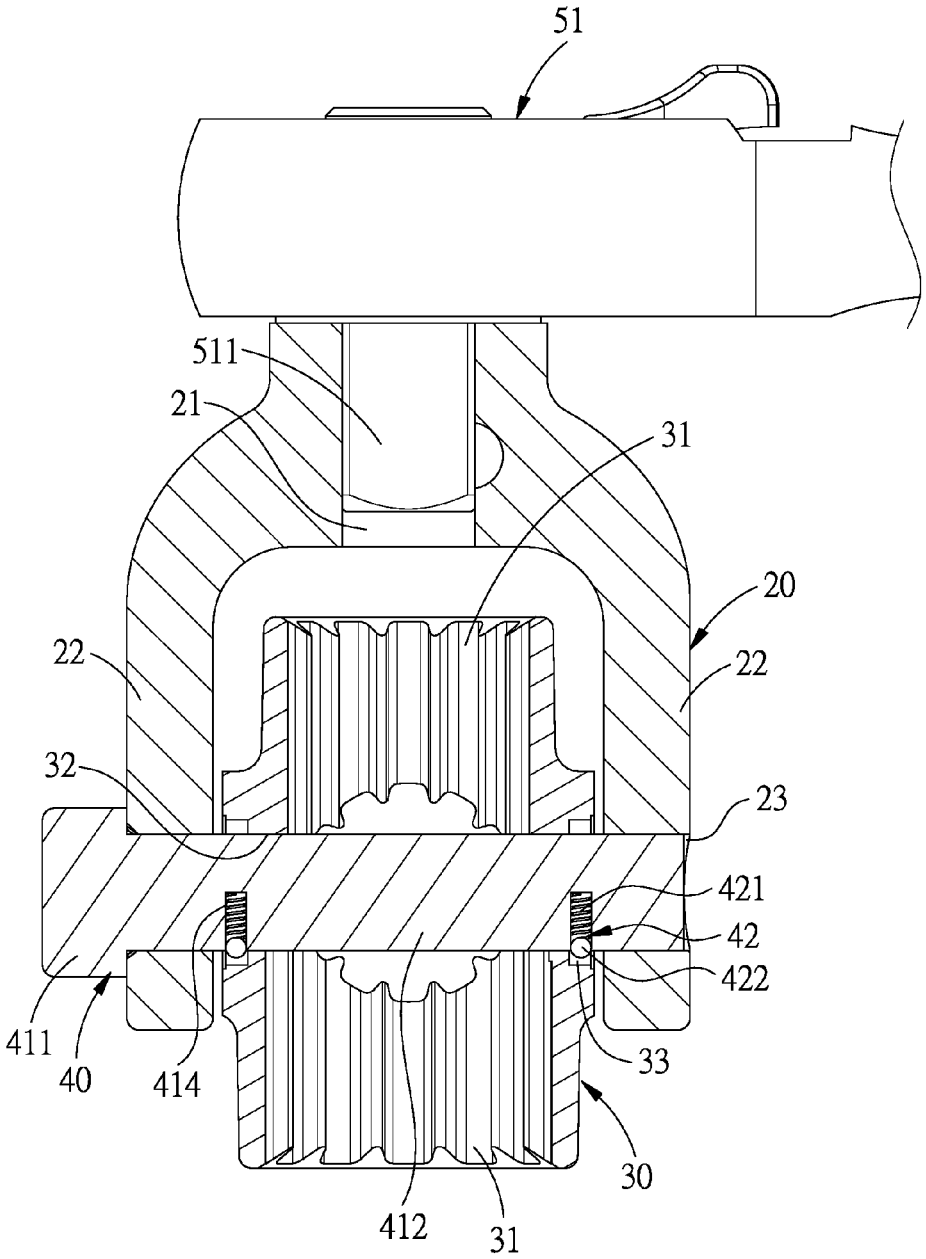
FIG. 4 is a cross sectional view of the multiple size socket in accordance with the first preferred embodiment of the present invention.

Referring to FIGS. 2-4, a multiple size socket in accordance with a first preferred embodiment of the present invention comprises: a base 20, a socket body 30, and a positioning unit 40.

The base 20 includes a connecting portion 21, two spaced pivot portions 22 formed on the connecting portion 21, and a pivot hole 23 formed in each of the pivot portions 22. In this embodiment, the connecting portion 21 is a hole for engaging with an engaging portion 511 (in the form of a protrusion) of a hand tool 51, and one of the pivot holes 23 is formed around the inner surface thereof with four shoulder portions 24.

The socket body 30 is pivoted between the two pivot portions 22 and includes four engaging cavities 31 and two inserting holes 32 aligned to the two pivot holes 23. In this embodiment, the engaging cavities 31 are located around the inserting holes 32 and different in size and shape from one another, and around the inner surface of each of the inserting holes 32 is formed a plurality of serrations 33.

The positioning unit 40 is inserted in the base 20 and the socket body 30, so that the socket body 30 is pivotable with respect to the base 20. In this embodiment, the positioning unit 40 includes a pin 41 and two positioning assemblies 42. The pin 41 includes a head portion 411 to be abutted against one of the pivot portions 22, a shaft portion 412 connected to the head portion 411 and inserted through the pivot holes 23 and the inserting holes 32, four protrusions 413 formed around the shaft portion 412 and abutted against the shoulder portions 24, and two recesses 414 formed in the shaft portion 412 and aligned to the serrations 33. Each of the positioning assemblies 42 includes a spring 421 received in the recesses 414 and a ball 422 received in the recesses 414 and pushed by the spring 421 against the serrations 33.

By such arrangements, the socket body 30 can be rotated to use different engaging cavities 31 to engage with different fasteners, and the engaging portion 511 of the hand tool 51 is engaged with the connecting portion 21 of the base 20, and then screwing and unscrewing operation can be carried out by turning the hand tool 51. To turn a fastener of another size, the socket body 30 can be rotated again to choose an appropriate engaging cavity 31 to fit the fastener. Since the socket body 30 is pivotally mounted on the base 20 by the positioning unit 40, and the socket body 30 is formed with different sized engaging cavities 31, a single socket of the present invention is capable of driving different sized fasteners, which makes the socket of the present invention easy to use and carry.

Due to the fact that the inserting holes 32 of the socket body 30 are formed with the serrations 33, the positioning assemblies 42 are disposed on the pin 41 of the positioning unit 40, and the ball 422 is pushed by the spring 421 against the serrations 33, it will produce an appropriate engaging force during the pivoting of the socket body 30, so that the socket body 30 can be well positioned after rotation, and the angle of the engaging cavities 31 of the socket body 30 with respect to the base 20 can be adjusted to provide an optimum screwing and unscrewing angle.

Figure 5:
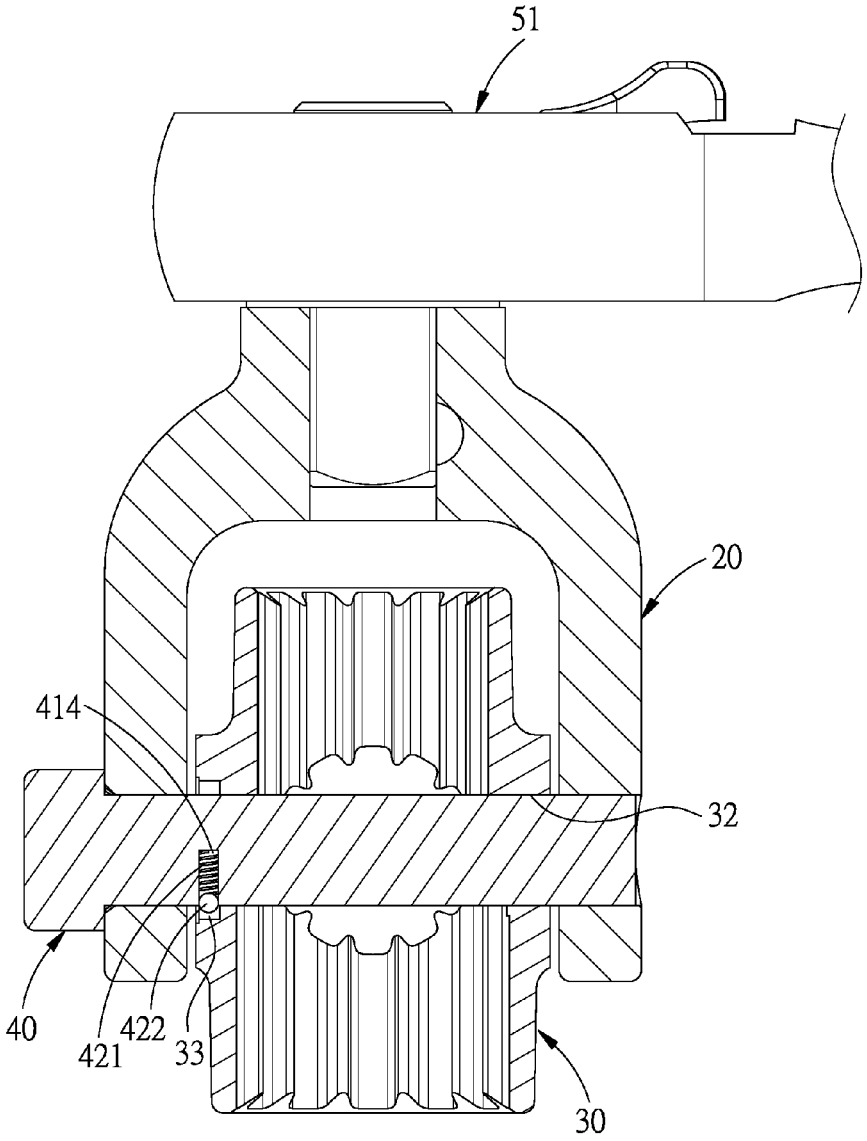
FIG. 5 is a cross sectional view of a multiple size socket in accordance with a second preferred embodiment of the present invention.

Referring then to FIG. 5, a multiple size socket in accordance with a second preferred embodiment of the present invention also comprises a base 20, a socket body 30, and a positioning unit 40 and is similar with the first embodiment, except that the base 20 is only formed with a plurality of serrations 33 on the inner surface of one of the inserting holes 32. The positioning unit 40 includes a pin 41 and a positioning assembly 42. The positioning assembly 42 includes a spring 421 received in the recesses 414 and a ball 422 received in the recesses 414 and pushed by the spring 421 against the serrations 33.

Figure 6:
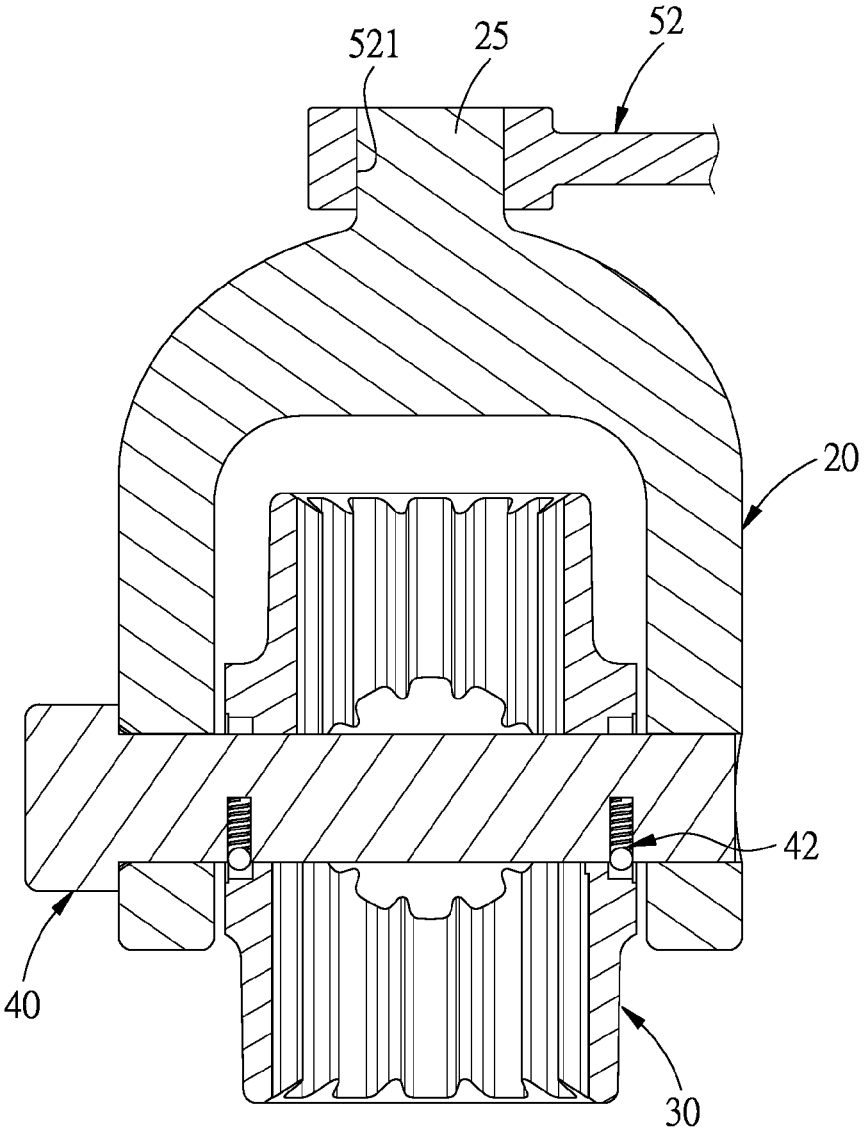
FIG. 6 is a cross sectional view of a multiple size socket in accordance with a third preferred embodiment of the present invention.

Referring then to FIG. 6, a multiple size socket in accordance with a third preferred embodiment of the present invention also comprises a base 20, a socket body 30, and a positioning unit 40 and is similar with the first embodiment, except that: the connecting portion 25 of the base 20 is a protrusion for engaging with an engaging portion 521 (in the form of a hole) of a hand tool 52.

While we have shown and described various embodiments in accordance with the present invention, it is clear to those skilled in the art that further embodiments may be made without departing from the scope of the present invention.

What is claimed is:

1. A multiple size socket comprising:

a base with a connecting portion, two pivot portions and a pivot hole formed in each of the pivot portions;

a socket body pivoted between the two pivot portions and including a plurality of engaging cavities and an inserting hole aligned with the two pivot holes; and a positioning unit inserted in the two pivot holes and the inserting hole;

wherein at least one of the pivot holes is formed around an inner surface thereof with a plurality of shoulder portions, around an inner surface of the inserting holes is formed a plurality of serrations, the positioning unit includes a pin and a positioning assembly, the pin includes a head portion to be abutted against one of the pivot portions, a shaft portion connected to the head portion and inserted through the pivot holes and the inserting hole, a plurality of protrusions formed around the shaft portion and abutted against the shoulder portions, and at least one recess formed in the shaft portion and aligned to the serrations, the positioning assembly includes a spring received in the recess and a ball received in the recess and pushed by the spring against the serrations.

2. The multiple size socket as claimed in claim 1, wherein the connecting portion is a hole or a protrusion.

3. The multiple size socket as claimed in claim 1, wherein the engaging cavities are located around the inserting holes.

4. The multiple size socket as claimed in claim 1, wherein the engaging cavities are different in size and shape from one another.

* * * * *